US012465116B1

(12) United States Patent
Xu

(10) Patent No.: US 12,465,116 B1
(45) Date of Patent: Nov. 11, 2025

(54) SHOE

(71) Applicant: Zhimin Xu, Guangzhou (CN)

(72) Inventor: Zhimin Xu, Guangzhou (CN)

(73) Assignee: Guangzhou Zhengtao Enterprise Management Co., Ltd., Guangzhou (CN)

( * ) Notice: Subject to any disclaimer, the term of this patent is extended or adjusted under 35 U.S.C. 154(b) by 0 days.

(21) Appl. No.: 19/070,571

(22) Filed: Mar. 5, 2025

Related U.S. Application Data

(63) Continuation-in-part of application No. 18/829,288, filed on Sep. 10, 2024.

(51) Int. Cl.

| | |
|---|---|
| ***A43B 17/08*** | (2006.01) |
| ***A43B 7/00*** | (2006.01) |
| *A43B 7/06* | (2006.01) |
| *A43B 7/08* | (2022.01) |
| *A43B 7/14* | (2022.01) |
| *A43B 13/20* | (2006.01) |
| *A43B 17/03* | (2006.01) |

(52) U.S. Cl.
CPC ..... *A43B 17/08* (2013.01); *A43B 7/005* (2013.01); *A43B 7/06* (2013.01); *A43B 7/081* (2013.01); *A43B 7/084* (2013.01); *A43B 7/087* (2013.01); *A43B 7/14* (2013.01); *A43B 13/20* (2013.01); *A43B 13/203* (2013.01); *A43B 17/03* (2013.01)

(58) Field of Classification Search
CPC ..... A43B 7/005; A43B 7/06; A43B 7/081; A43B 7/084; A43B 7/087; A43B 7/14; A43B 17/03; A43B 17/08; A43B 13/20; A43B 13/203
USPC ..... 36/3 R, 29, 43
See application file for complete search history.

(56) References Cited

U.S. PATENT DOCUMENTS

| | | | | | |
|---|---|---|---|---|---|
| 5,086,572 | A * | 2/1992 | Lee | A43B 7/081 | 36/3 R |
| 5,295,313 | A * | 3/1994 | Lee | A43B 7/082 | 36/3 R |
| 5,367,788 | A * | 11/1994 | Chen | A43B 3/34 | 36/2.6 |
| 5,375,345 | A * | 12/1994 | Djuric | A43B 7/081 | 36/3 R |
| 5,918,381 | A * | 7/1999 | Landry | A43B 7/005 | 36/3 R |
| 6,041,518 | A * | 3/2000 | Polycarpe | A43B 7/081 | 36/3 R |
| 6,370,800 | B1 * | 4/2002 | Hung | A43B 7/08 | 36/29 |

(Continued)

*Primary Examiner* — Alissa J Tompkins
*Assistant Examiner* — Dakota Marin

(57) ABSTRACT

A shoe includes a shoe sole and a shoe main body. The shoe sole is configured to be connected to the shoe main body and forms an accommodating space with the shoe main body. The shoe sole includes a supporting member and a supporting insole. The supporting member is provided with a blowing device and a blowing channel. One end of the blowing channel is connected to the blowing device, and the other end is connected to the upper surface of the supporting member. The supporting insole includes an insole surface; an air hole is provided in the insole surface; one end of the air hole is configured to be communicated to the accommodating space; the supporting insole is arranged on the supporting member.

19 Claims, 15 Drawing Sheets

(56) References Cited

U.S. PATENT DOCUMENTS 6,434,858 B2 * 8/2002 Pan ..... A43B 7/08 36/3 R
6,725,571 B2 * 4/2004 Liu ..... A43B 1/0045 36/3 R
6,775,926 B1 * 8/2004 Huang ..... A43B 13/206 36/3 B
8,191,284 B2 * 6/2012 Cho ..... A43B 13/12 36/28
8,209,882 B2 * 7/2012 Leimer ..... A43B 17/08 36/3 R
9,107,468 B1 * 8/2015 Xiong ..... A43B 3/35
10,390,586 B2 * 8/2019 Litvinov ..... A43B 3/40
10,433,613 B2 * 10/2019 Litvinov ..... A43B 3/38
10,736,377 B1 * 8/2020 Fotouhie ..... A43B 7/087
11,297,893 B2 * 4/2022 Dulude ..... A43B 13/125
11,357,282 B2 * 6/2022 Cohen ..... A43B 3/35
12,016,434 B1 * 6/2024 Nedelcu ..... A43B 7/081
12,150,524 B2 * 11/2024 Chen ..... A43B 7/087
2003/0121175 A1 * 7/2003 Bertolami ..... A43B 7/081 36/3 R
2005/0005473 A1 * 1/2005 Oh ..... A43B 7/081 36/3 R
2005/0235523 A1 * 10/2005 Flechsig ..... A43B 13/182 36/3 R
2007/0277391 A1 * 12/2007 Beckett ..... A47L 23/205 34/104
2008/0005936 A1 * 1/2008 Chiu ..... A43B 7/146 36/2.6
2010/0005687 A1 * 1/2010 Ramadoro ..... A43B 7/082 36/29
2011/0162240 A1 * 7/2011 Pieri ..... A43B 7/082 36/3 B
2012/0216432 A1 * 8/2012 Byrne ..... A43B 9/02 36/3 B
2014/0259750 A1 * 9/2014 Yeh ..... A43B 13/20 36/29
2016/0088896 A1 * 3/2016 Acevedo ..... A43B 7/083 36/3 A
2019/0159546 A1 * 5/2019 Cohen ..... A43B 3/35
2021/0186142 A1 * 6/2021 Chiu ..... A43B 7/06

* cited by examiner

SHOE

CROSS-REFERENCE TO RELATED APPLICATIONS

This application is a Continuation-in-Part of the U.S. application Ser. No. 18/829,288 filed on Sep. 10, 2024, and entitled "COOLING INSOLE AND COOLING SHOE" now pending, the entire inventions of which are incorporated herein by reference.

TECHNICAL FIELD

The present invention relates to the technical field of shoes, and in particular, to a shoe.

BACKGROUND OF THE INVENTION

With the improvement of the living standard of people, consumers have increasingly high requirements for the comfort level of wearing shoes, hats, and clothes. For example, for shoes, in addition to requiring comfortable fit, the consumers also have higher requirements for dryness and breathability of the shoes.

In the hot summer, as the outside temperature rises, the temperature inside the shoes also increases. If heat and moisture that are generated inside a shoe cannot be discharged in time, they will bring a strong sense of discomfort to a wearer of the shoe and easily lead to a series of foot diseases. Although some shoes are made more breathable by arranging breathable meshes on shoe main bodies, these shoes have low ventilation efficiency and poor cooling and moisture removal effects. Moreover, only the breathable meshes cannot effectively achieve air flow circulation, so that temperatures inside the shoes cannot be effectively lowered.

Therefore, the present invention provides a shoe which can effectively solve the above problem.

SUMMARY OF THE INVENTION

To overcome the shortcomings in the prior art, the present invention provides a shoe which has a simple structure and can actively accelerate air flowing inside the shoe to effectively ensure a cooling effect, thereby avoiding the problem of bacteria breeding caused by moisture in a shoe cavity due to sweat of a foot. In addition, a user feels comfortable when wearing the shoe.

The technical solution adopted by the present invention to solve the technical problem is as follows.

A shoe includes a shoe sole and a shoe main body. The shoe sole is configured to be connected to the shoe main body and forms an accommodating space with the shoe main body. The shoe sole includes a supporting member and a supporting insole.

The supporting member is provided with a blowing device and a blowing channel. The blowing device is communicated to the blowing channel and conveys air to the accommodating space through the blowing channel. The supporting insole includes an insole surface; an air hole is provided in the insole surface; one end of the air hole is configured to be communicated to the accommodating space; the supporting insole is arranged on the supporting member; the blowing device sucks the air from the accommodating space and forms a relatively low pressure region in a region of the accommodating space close to the blowing device, so that an air passage rate is increased while the air inside the accommodating space forms an internal circulation path.

As an improvement of the present invention, the supporting insole further includes an abutted surface; the insole surface and the abutted surface are respectively arranged on two opposite sides of the supporting insole; and the other end of the air hole is communicated to the abutted surface.

As an improvement of the present invention, supporting convex posts are arranged on the insole surface; the supporting convex posts are fixedly connected to the insole surface, and the supporting convex posts and the insole surface together form an air guide mesh groove; the supporting convex posts are configured to support a foot of a user; the air guide mesh groove is configured to form an air flow path to perform secondary distribution on the air blown in through the blowing channel, so that the air blown in through the blowing channel enters the accommodating space more uniformly through the air guide mesh groove.

As an improvement of the present invention, the blowing device includes an air inlet and an air outlet, and the air inlet is connected to the accommodating space.

As an improvement of the present invention, a temperature adjustment device is arranged at the air outlet; and the temperature adjustment device is configured to heat or cool air flow flowing out from the air outlet.

As an improvement of the present invention, a height of each supporting convex post is at least 1 mm; a distance between the supporting convex posts is 1 mm to 15 mm; a depth of the air guide mesh groove is limited by the heights of the supporting convex posts; and a groove width of the air guide mesh groove is limited by the distance between the supporting convex posts.

As an improvement of the present invention, the isolation insole is arranged between the supporting member and the supporting insole; and the isolation insole is provided with an air outlet hole and an air inlet hole.

As an improvement of the present invention, a hollow layer is formed by the supporting insole and an upper surface of the supporting member; the other end of the air hole is configured to be communicated to the hollow layer; and one end of the blowing channel is connected to the blowing device, and the other end is connected to the upper surface of the supporting member.

As an improvement of the present invention, the supporting insole includes an insole surface and a supporting column; the supporting column extends downward from a lower surface of the insole surface to the upper surface of the supporting member to form the hollow layer with the upper surface of the supporting member; the air hole configured to communicate the accommodating space to the hollow layer is provided in the insole surface; the hollow layer performs secondary distribution on the air blown in through the blowing channel, so that the air blown in through the blowing channel enters the accommodating space more uniformly through the air hole.

As an improvement of the present invention, the supporting insole includes a supporting column; the supporting column extends downward from a lower surface of the insole surface to the upper surface of the supporting member; and the supporting column is configured to support the insole surface.

As an improvement of the present invention, the supporting column extends downward from a lower surface of the insole surface to the upper surface of the supporting member to form the hollow layer with the upper surface of the supporting member; and a ventilation slot configured to communicate the accommodating space to the hollow layer is formed in a side surface of the insole surface.

As an improvement of the present invention, the supporting insole is provided with a ventilation unit; and the ventilation unit extends from a middle portion of a front end of the supporting insole to a side portion of the front end.

As an improvement of the present invention, the blowing device includes a power supply, a fan, and a circuit board.

As an improvement of the present invention, the power supply is removable.

As an improvement of the present invention, the supporting member is provided with a temperature sensing device; the temperature sensing device is configured to detect a temperature in the accommodating space; the temperature sensing device is controlled by a preset program in a mobile terminal; and the preset program automatically adjusts power of the fan according to a data change fed back by the temperature sensing device.

As an improvement of the present invention, the blowing device is arranged at a middle portion of the supporting member.

As an improvement of the present invention, the supporting convex posts are substantially uniformly distributed on the insole surface; and a cross section of each supporting convex post is circular or polygonal.

As an improvement of the present invention, the air hole is provided in a bottom of the air guide mesh groove; and the air hole is communicated to the accommodating space through the air guide mesh groove.

As an improvement of the present invention, the abutted surface is provided with an air return slot; and the other end of the air hole is configured to be communicated to the air return slot.

As an improvement of the present invention, the air return slot extends from a middle portion of the supporting insole to a rear portion of the supporting insole.

Beneficial effects: by the arrangement of the above structure, during use, the blowing device sucks an air flow from the accommodating space through an air inlet connected to the accommodating space, and the sucked air flow enters the blowing channel through an air outlet via an air inlet end, enters the hollow layer through an air outlet end from the blowing channel, and finally flows back into the accommodating space, thereby forming a circulation path of the air flow, which can accelerate the circulation of the air inside and outside a shoe. This ensures that the accommodating space in the shoe is dry and breathable. Furthermore, the air flow that continuously flows from the air outlet end to the air inlet can be formed in the accommodating space in the shoe. The air flow is blown to the sole of the foot through the supporting insole; good ventilation, sweat discharging, and cooling effects can be achieved; the ventilation and cooling efficiency in the shoe is greatly improved; and the user experience is enhanced.

BRIEF DESCRIPTION OF DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work. In addition, the accompanying drawings are not drawn to a scale of 1:1, and the relative dimensions of the various elements are only shown as examples in the diagrams, not necessarily drawn to a true scale.

The present invention is further described below in detail in combination with the accompanying drawings and embodiments.

DETAILED DESCRIPTION OF THE INVENTION

Figure 1:
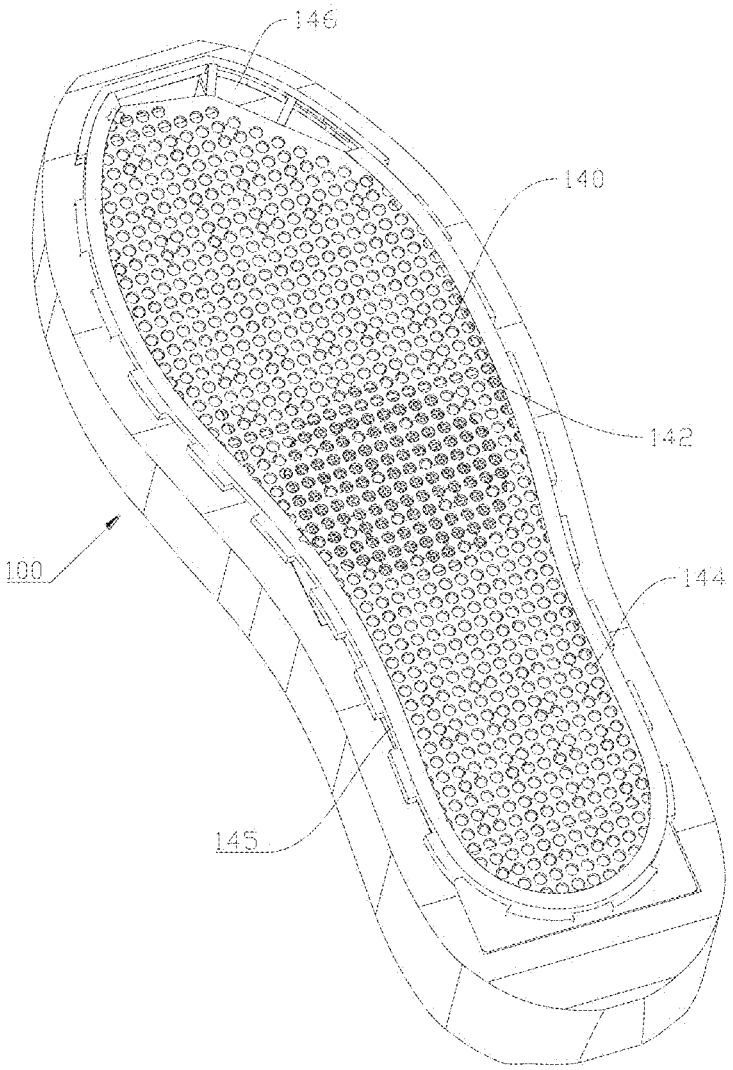
FIG. 1 is a schematic diagram of an entire structure of an insole of a shoe according to Embodiment I of the present invention.

To make the aforementioned objectives, features, and advantages of the present invention more comprehensible, specific implementations of the present invention are described in detail below in conjunction with the accompanying drawings. In the following description, numerous specific details are set forth to provide a thorough understanding of the present invention. The present invention may, however, be embodied in many forms different from that described here. A person skilled in the art can make similar improvements without departing from the connotation of the present invention. Therefore, the present invention is not limited by the specific embodiments disclosed below.

In the description of the present invention, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present invention and simplifying the description, Rather than indicating or implying that the indicated device or element must have a particular orientation, be constructed and operated in a particular orientation, therefore, not to be construed as limiting the present invention.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present invention, "multiple" means two or more unless explicitly specified otherwise.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present invention can be understood based on specific circumstances.

In the present invention, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Figure 2:
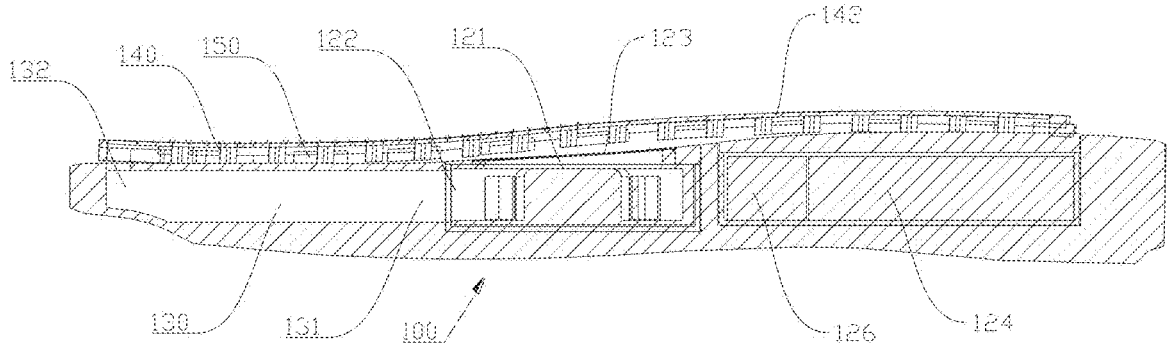
FIG. 2 is a schematic diagram of a sectional structure of an insole of a shoe according to Embodiment I of the present invention.
Figure 3:
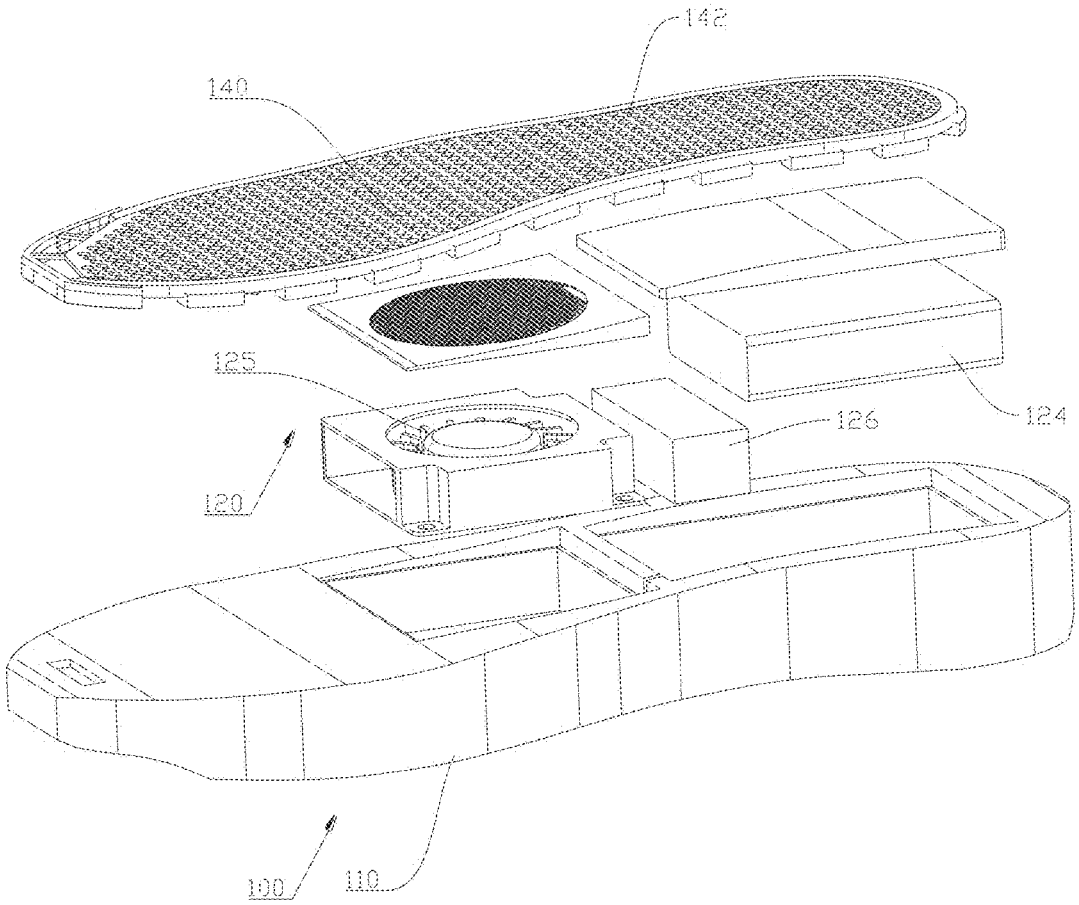
FIG. 3 is a schematic diagram of an exploded structure of an insole of a shoe according to Embodiment I of the present invention.
Figure 4:
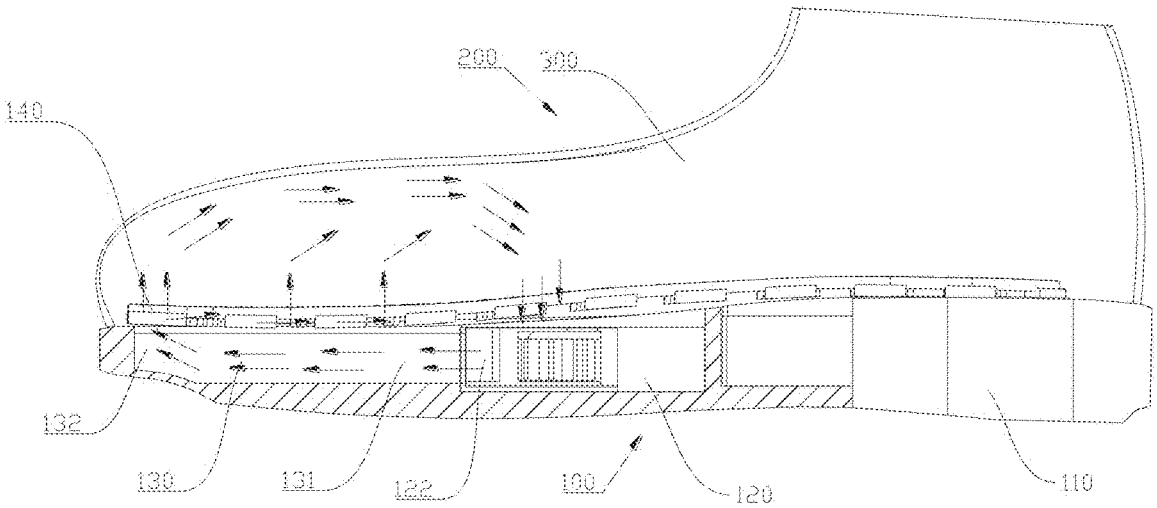
FIG. 4 is a schematic diagram of circulation of an air flow in a shoe in a first angle according to Embodiment I of the present invention.
Figure 5:
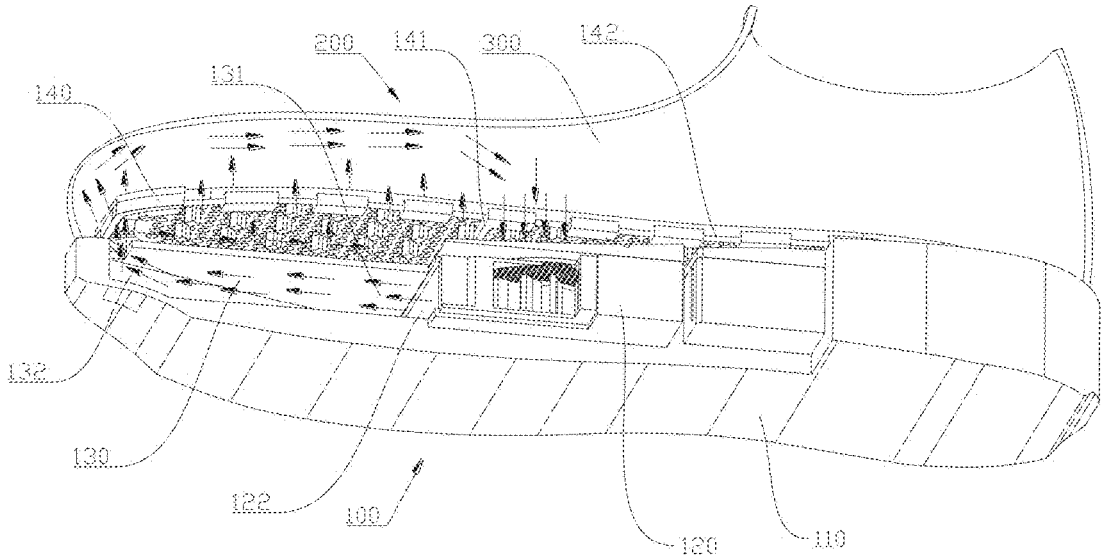
FIG. 5 is a schematic diagram of circulation of an air flow in a shoe in a second angle according to Embodiment I of the present invention.
Figure 6:
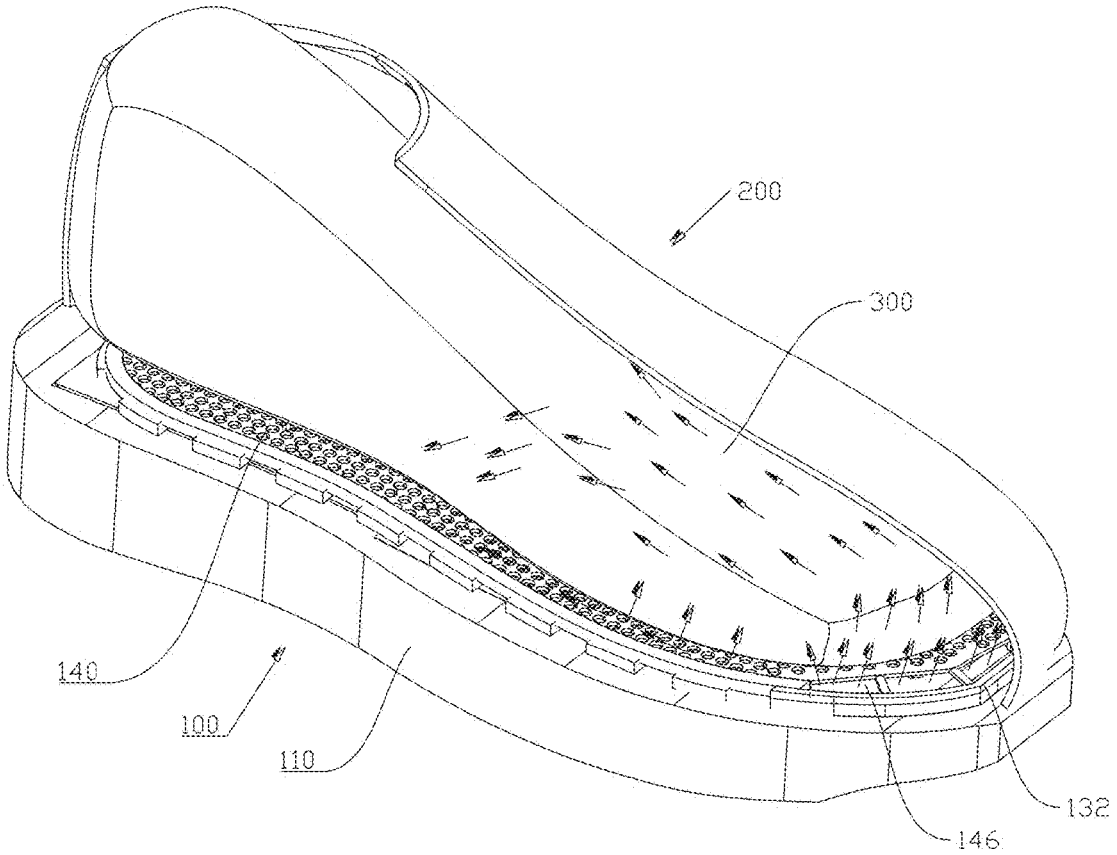
FIG. 6 is a schematic diagram of circulation of an air flow in a shoe in a third angle according to Embodiment I of the present invention.
Figure 7:
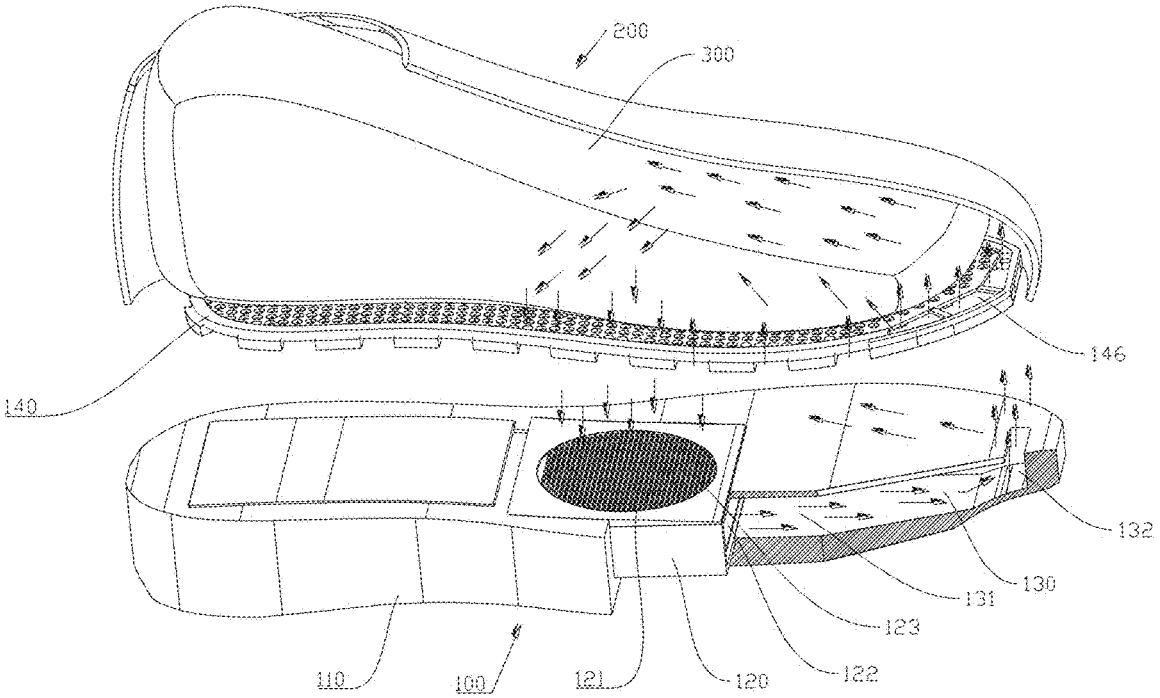
FIG. 7 is a schematic diagram of circulation of an air flow in a shoe in a fourth angle according to Embodiment I of the present invention.
Figure 8:
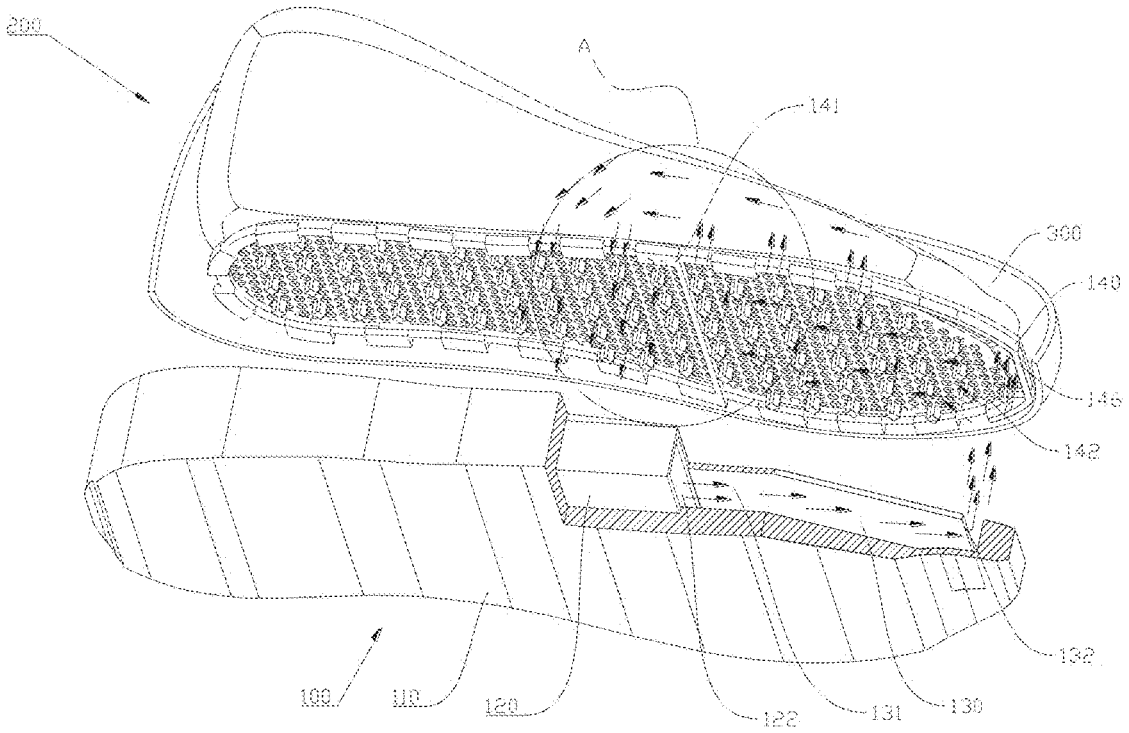
FIG. 8 is a schematic diagram of circulation of an air flow in a shoe in a fifth angle according to Embodiment II of the present invention.
Figure 9:
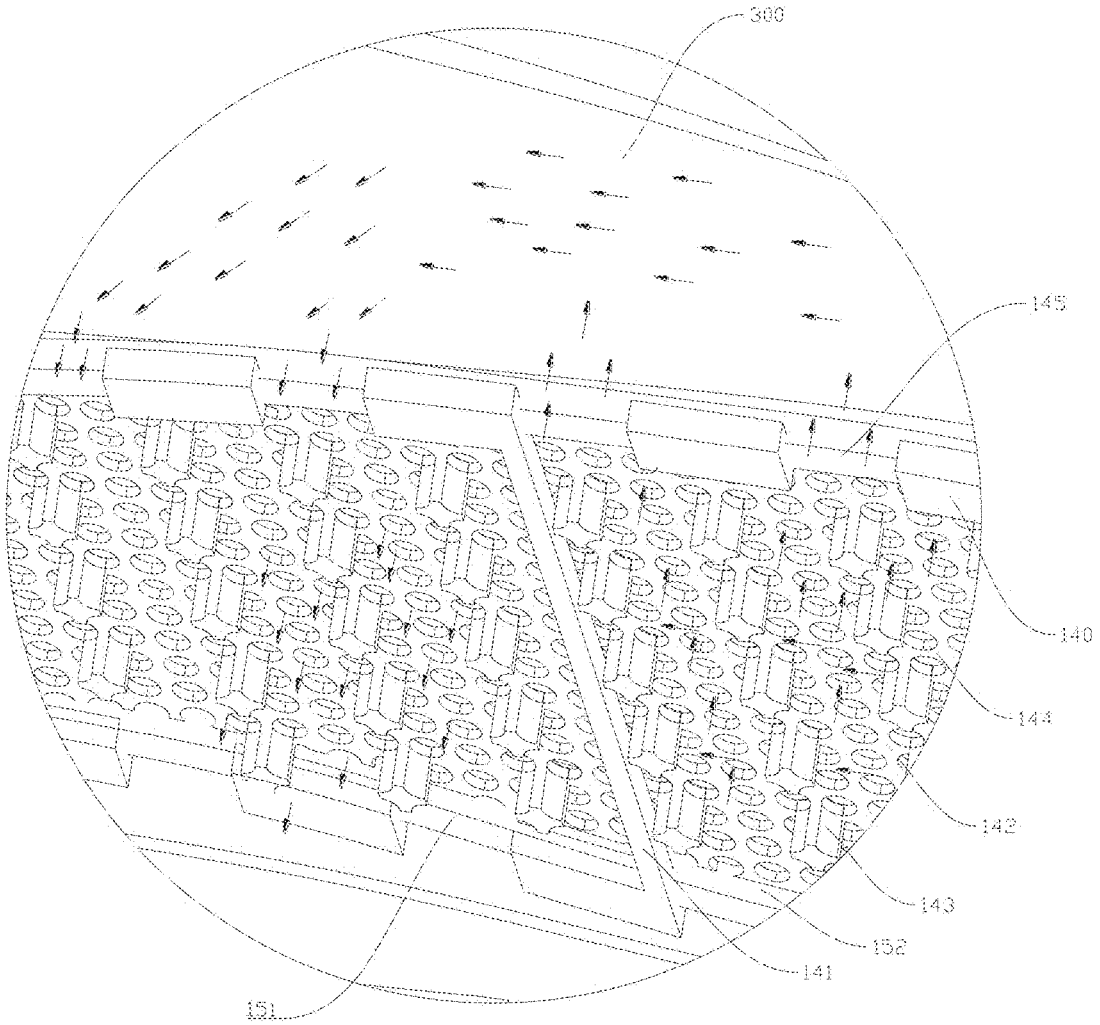
FIG. 9 is an enlarged view of circle A in FIG. 8.
Figure 10:
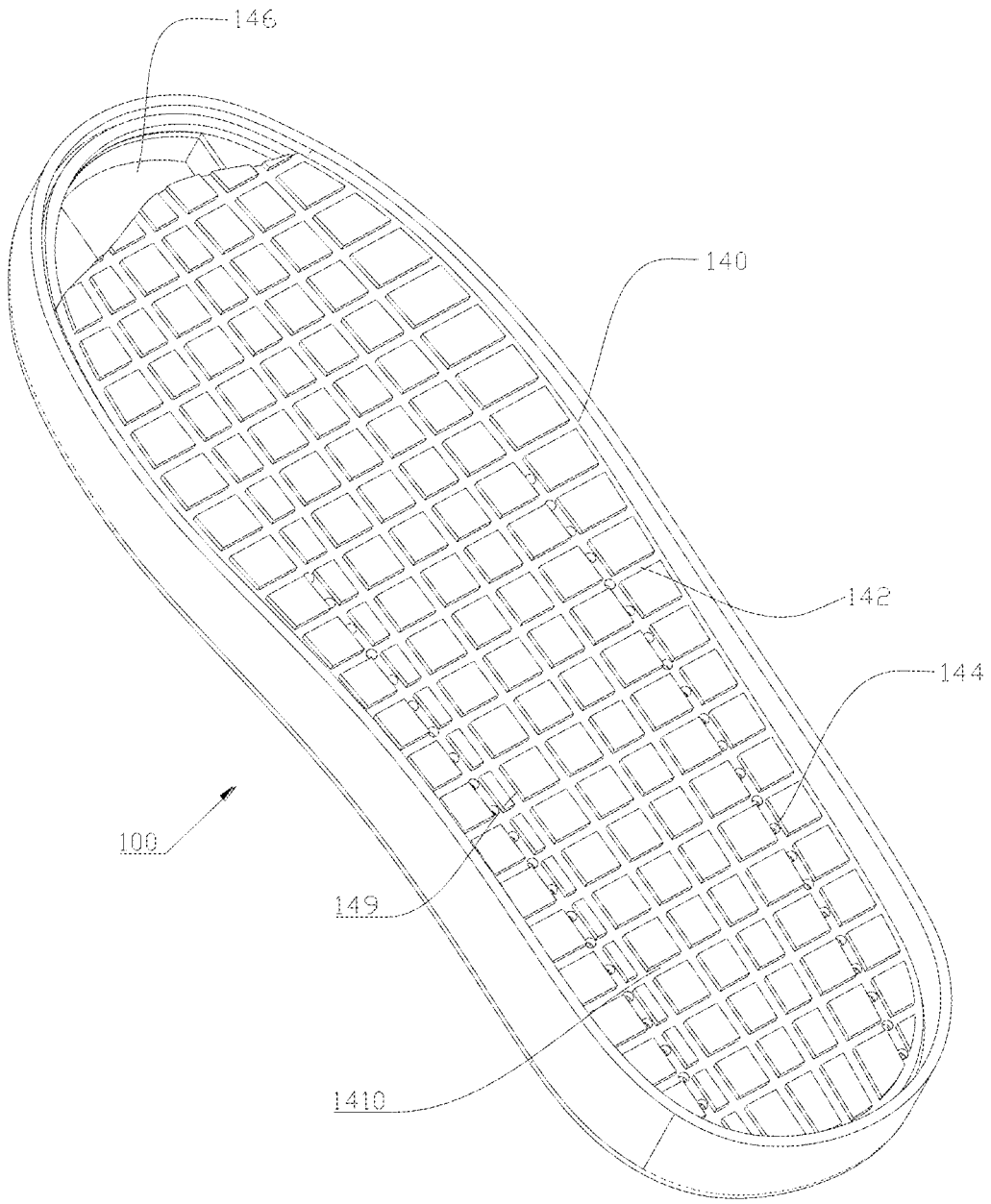
FIG. 10 is a schematic diagram of an entire structure of an insole of a shoe according to Embodiment II of the present invention.
Figure 11:
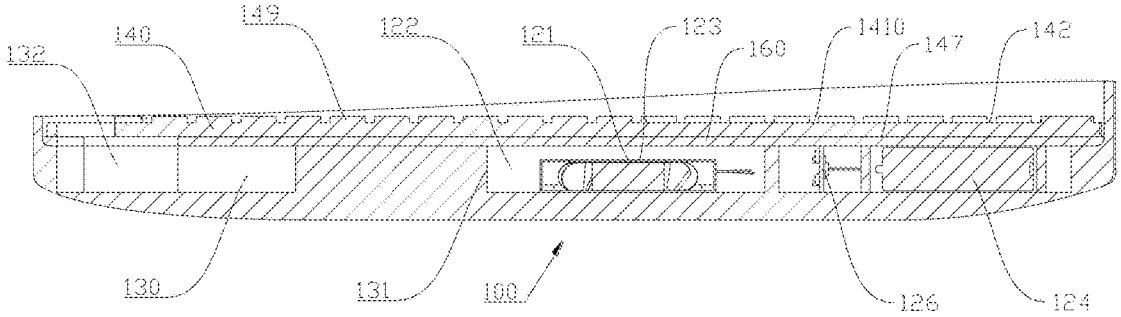
FIG. 11 is a schematic diagram of a sectional structure of an insole of a shoe according to Embodiment II of the present invention.
Figure 12:
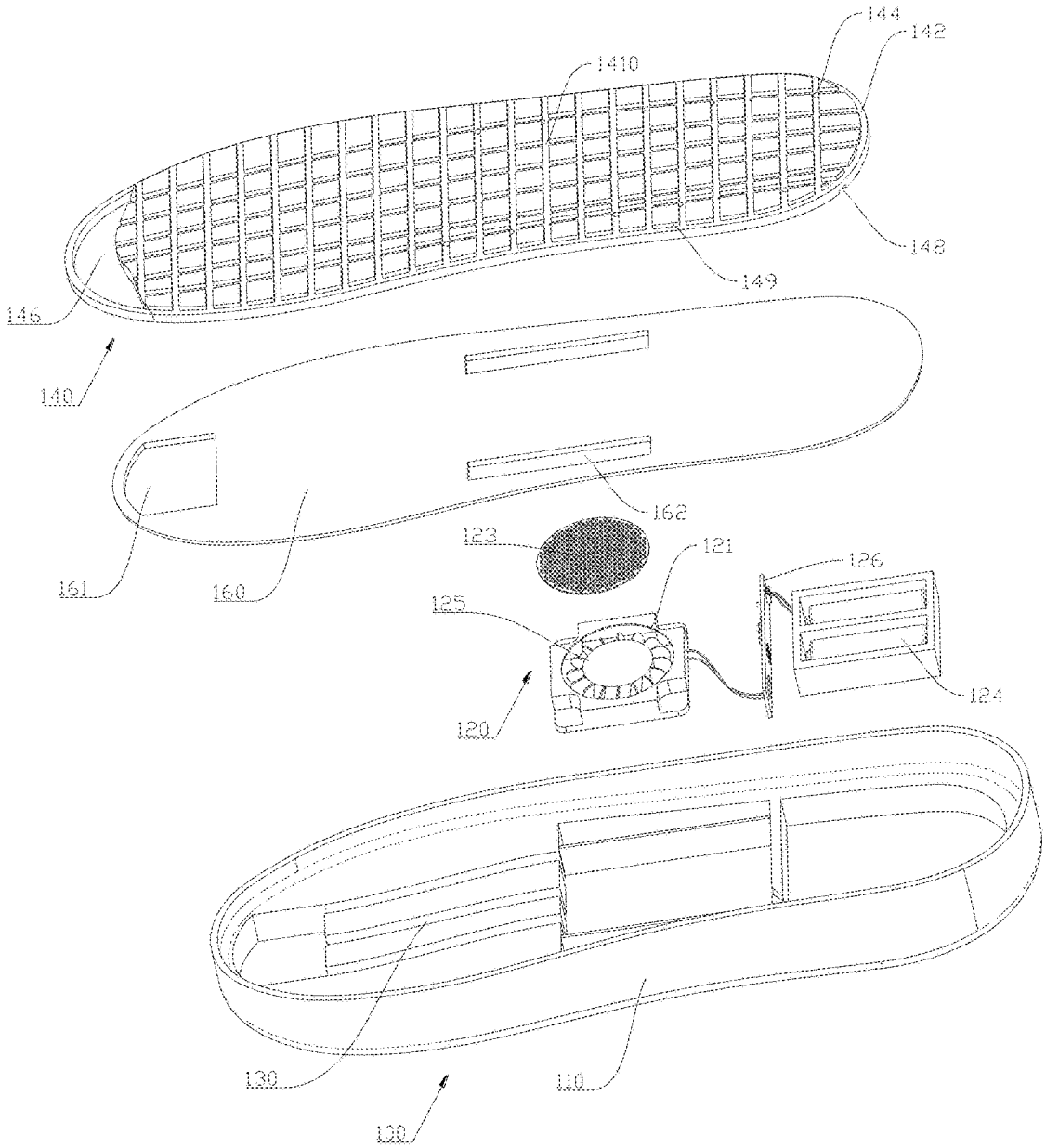
FIG. 12 is a schematic diagram of an exploded structure of an insole of a shoe according to Embodiment II of the present invention, in a first perspective.
Figure 13:
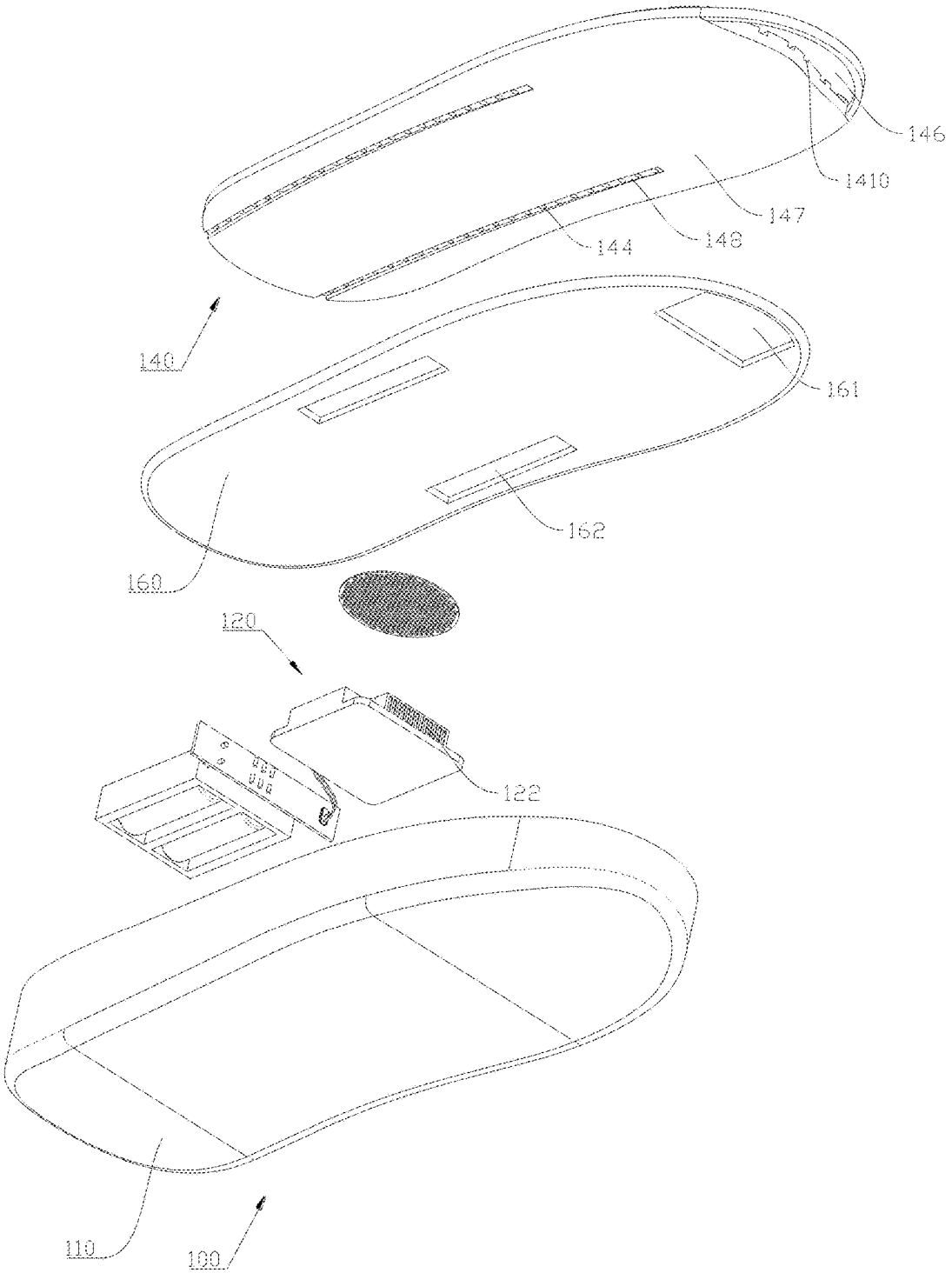
FIG. 13 is a schematic diagram of an exploded structure of an insole of a shoe according to Embodiment II of the present invention, in a second perspective.
Figure 14:
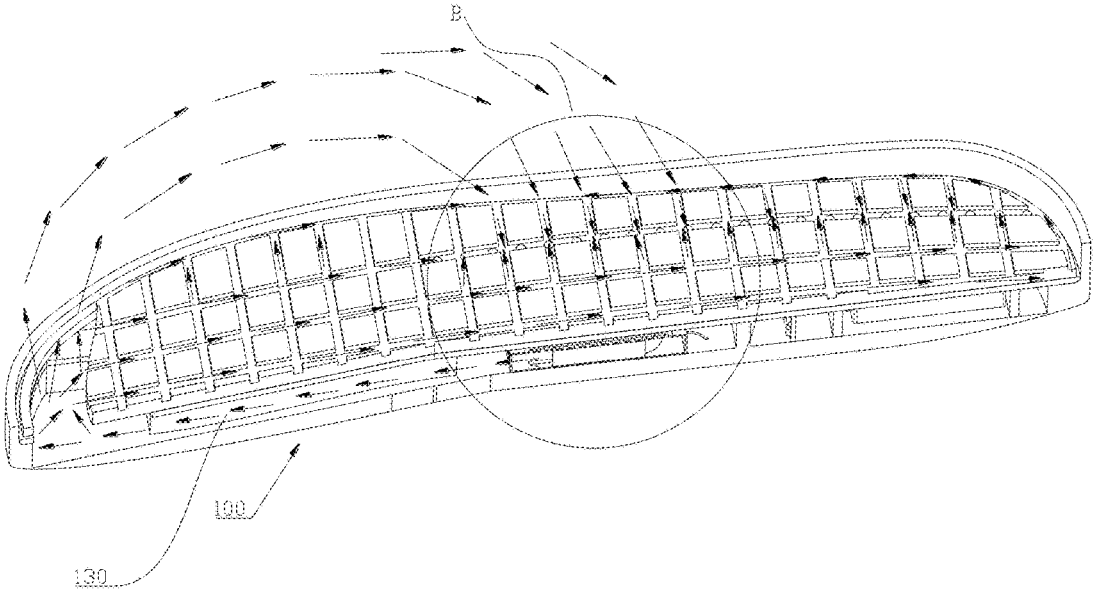
FIG. 14 is a schematic diagram of circulation of an air flow in a shoe in a first angle according to Embodiment II of the present invention.
Figure 15:
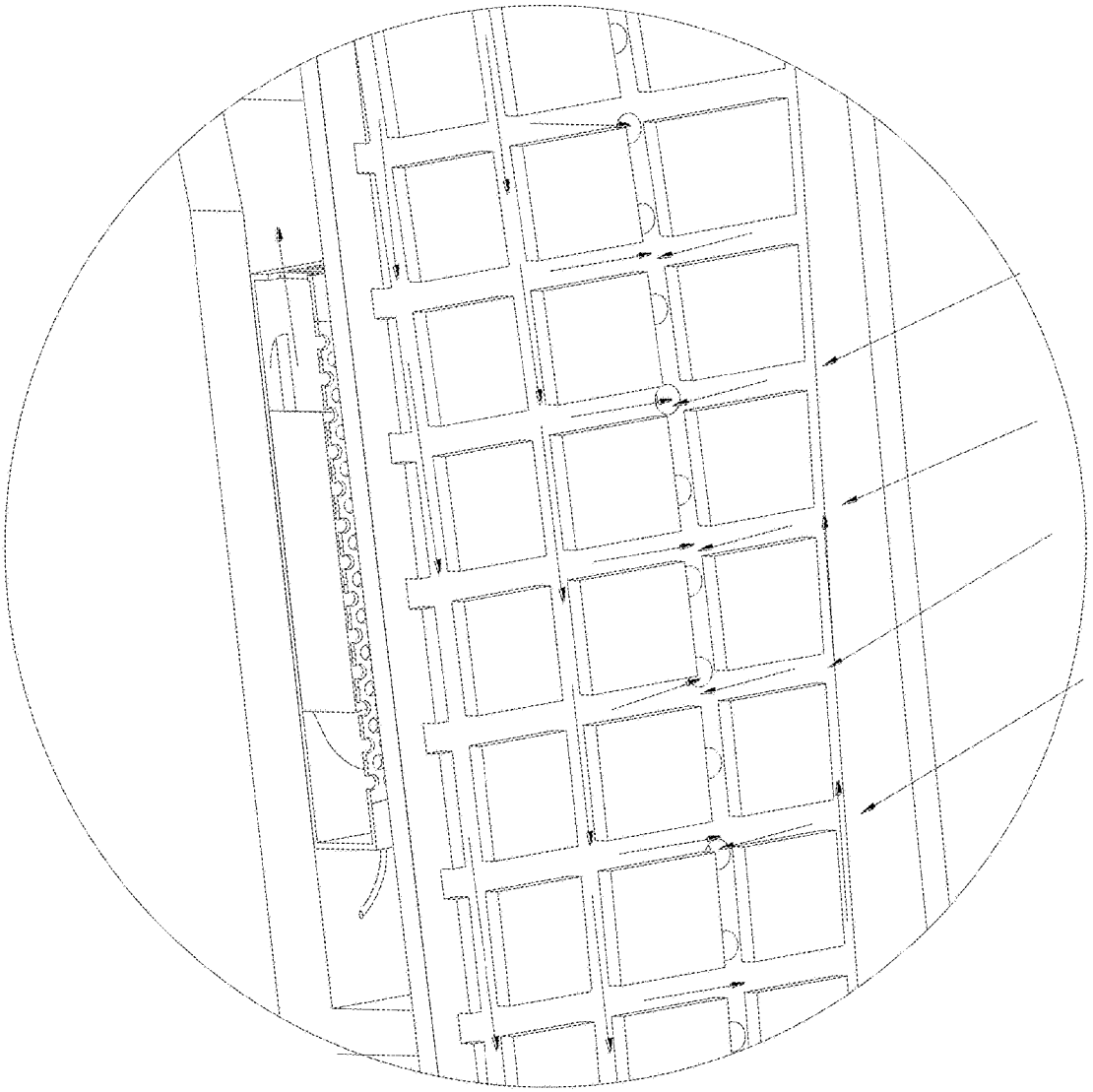
FIG. 15 is an enlarged view of circle A in FIG. 14.
Figure 16:
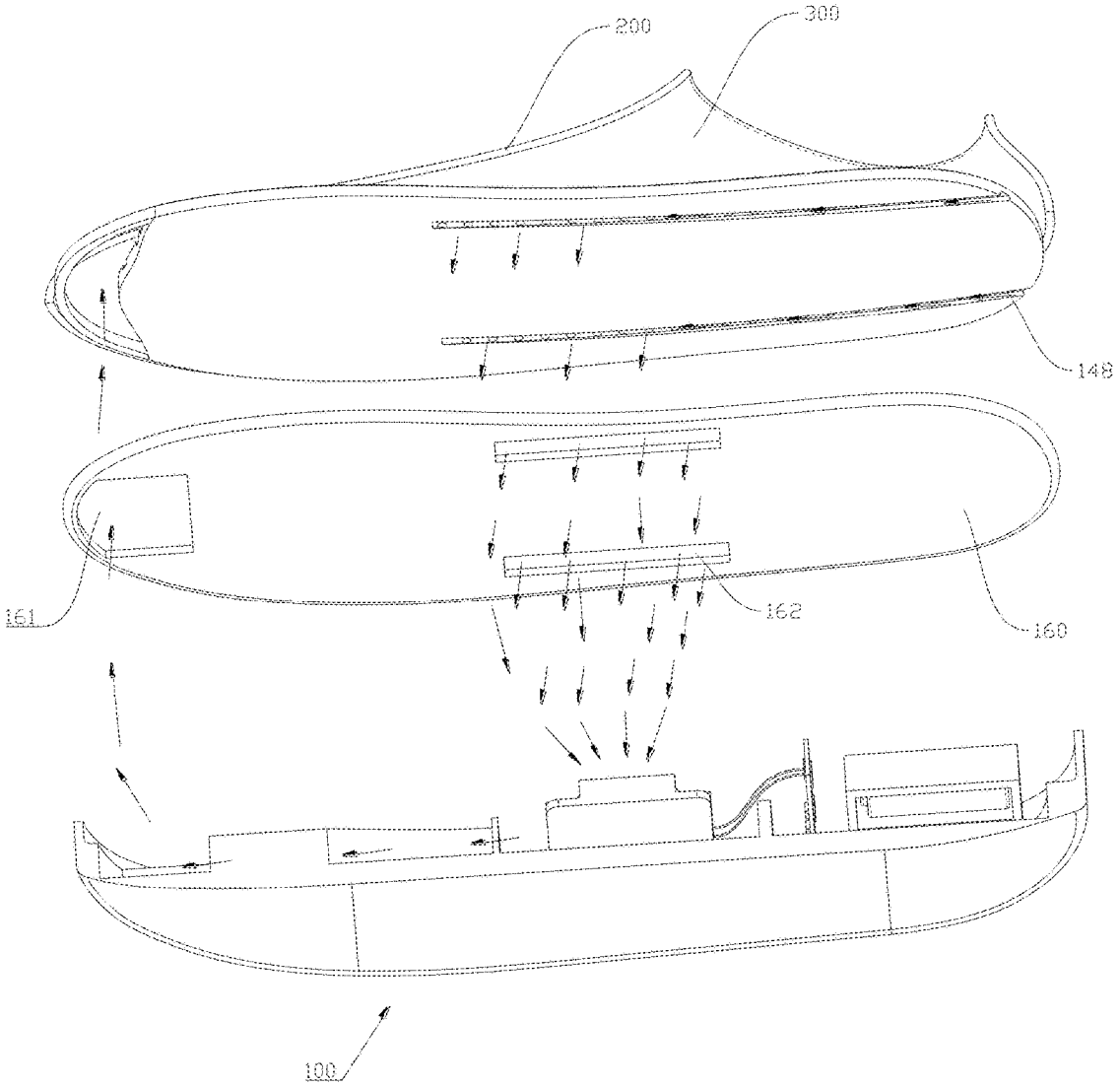
FIG. 16 is a schematic diagram of circulation of an air flow in a shoe in a second angle according to Embodiment II of the present invention.
Figure 17:
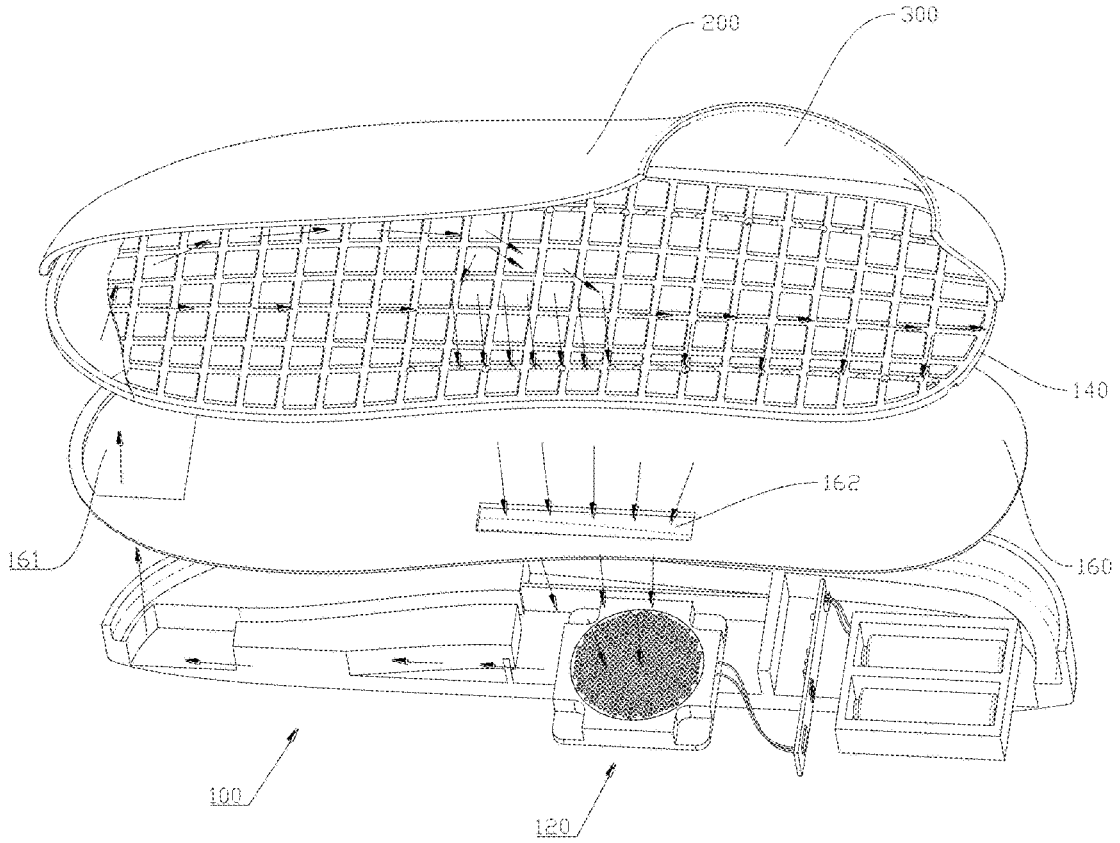
FIG. 17 is a schematic diagram of circulation of an air flow in a shoe in a third angle according to Embodiment II of the present invention.

Referring to FIG. 1 to FIG. 17, a shoe includes a shoe sole 100 and a shoe main body 200. The shoe sole 100 is configured to be connected to the shoe main body 200 and forms an accommodating space 300 with the shoe main body 200. The shoe sole 100 includes a supporting member 110 and a supporting insole 140.

The supporting member 110 is provided with a blowing device 120 and a blowing channel 130. The blowing device 120 is communicated to the blowing channel 130 and conveys air to the accommodating space 300 through the blowing channel 130.

The supporting insole 140 includes an insole surface 142. An air hole 144 is formed in the insole surface 142. One end of the air hole 144 is configured to be communicated to the accommodating space 300. The supporting insole 140 is arranged on the supporting member 110. The blowing device 120 sucks air from the accommodating space 300 and forms a relatively low pressure region in a region of the accommodating space 300 close to the blowing device 120, so that an air passage rate is increased while the air inside the accommodating space 300 forms an internal circulation path.

By the arrangement of the above structure, during use, the shoe sole 100 is connected to the shoe main body 200 to form the accommodating space 300, thus providing wrapping and protection for a foot. The supporting member 110 plays a role in supporting the entire foot. The blowing device 120 is core power source of a heat dissipation system and/or a cooling system, which generates an air flow through operation and conveys the air to the blowing channel 130. The blowing channel 130 is responsible for guiding the air flow generated by the blowing device 120 to the accommodating space 300, which ensures that the air flow can accurately flow toward the feet, provides a directional air flow for heat dissipation and/or cooling, and achieves effective heat exchange. The supporting insole 140 directly supports the foot, to further disperse pressure and improve the wearing comfort level. One end of the air hole 144 is communicated to the accommodating space 300. When the blowing device 120 conveys the air to the accommodating space 300 through the blowing channel 130, the air can enter a position above the supporting insole 140 through the air hole and be exchanged with hot air and/or cold air around the foot, thus accelerating heat dissipation for foot heat dissipation and/or cooling, effectively improving a muggy environment of the foot, and reducing odor and bacteria breeding. It should be noted that when both a cooling effect and a heat dissipation effect need to be achieved in the same product, corresponding temperature adjustment devices need to be added as cooling or heating sources.

In this embodiment, the supporting insole 140 further includes an abutted surface 147. The insole surface 142 and the abutted surface 147 are respectively arranged on two opposite sides of the supporting insole 140. The abutted surface 147 is provided with an air return slot 148. The other end of the air hole 144 is configured to be communicated to the air return slot 148. By the arrangement of the above structure, during use, the insole surface 142 is configured to be in direct contact with the foot, to provide a support and a comfort level, and the abutted surface 147 is responsible for cooperating with another component such as the shoe sole. A main function of the air return slot 148 is to guide air to flow back. When the blowing device 120 conveys the air to the accommodating space 300 through the blowing channel 130, after the air reaches a position above the insole through the air hole 144 and is mixed with hot air around the foot, a channel for backflow is required. The air return slot 148 provides a backflow path for the hot air, so that the air can be circulated to ensure continuous and effective operation of the heat dissipation system. One end of the air hole 144 is communicated to the accommodating space 300, and the other end is communicated to the air return slot 148, thus forming a complete air circulation channel from the blowing device 120 to the blowing channel 130 to the accommodating space 300 to the air hole 144 to the air return slot 148, so that the air can flow in an orderly manner inside the shoe and achieve a circulation process of heat dissipation.

In this embodiment, supporting convex posts 149 are arranged on the insole surface 142. The supporting convex posts 149 are fixedly connected to the insole surface 142, and the supporting convex posts 149 and the insole surface 142 together form an air guide mesh groove 1410. The supporting convex posts 149 are configured to support a foot of a user. The air guide mesh groove 1410 is configured to form an air flow path to perform secondary distribution on the air blown in through the blowing channel 130, so that the air blown in through the blowing channel 130 enters the accommodating space 300 more uniformly through the air guide mesh groove 140. By the arrangement of the above structure, during use, the air guide mesh groove 1410 can perform the secondary distribution on the air blown in through the blowing channel 130, so that part of the air flow is conveyed to a rear portion of the supporting insole 140 along a middle portion of the air guide mesh groove 1410 correspondingly between air return slots 148 on two sides, and then enters the air return slots 148 through the air hole 144. Another part of the air flow is conveyed to the rear portion of the supporting insole 140 along two sides of part of the air guide mesh groove 1410 corresponding to the air return slots 148 on the two sides, and then enters the air return slots 148 through the air hole 144, so that the air can enter the accommodating space 300 more uniformly, which ensures that the entire accommodating space 300 can achieve effective air circulation and heat dissipation. The supporting convex posts 149 can provide stable supporting points during movement of the foot, avoiding excessive movement of the foot on the supporting insole 140, maintaining a relatively fixed positional relationship between the foot and the supporting insole 140, improving the stability during walking or movement, and reducing the possibility of an accident such as slippage or sprain.

In this embodiment, a height of each supporting convex post 149 is 2 mm to 4 mm; a distance between the supporting convex posts 149 is 1 mm to 15 mm; a depth of the air guide mesh groove 1410 is limited by the heights of the supporting convex posts 149; and a groove width of the air guide mesh groove 1410 is limited by the distance between the supporting convex posts 149. By the arrangement of the above structure, during use, a depth of the air guide mesh groove 1410 is limited by the heights of the supporting convex posts 149, and the groove width is limited by the distance between adjacent supporting convex posts 149. This design can accurately control a shape and size of the air guide mesh groove, thereby better guiding the air flow. An appropriate depth and groove width can reduce turbulence and resistance when the air flow flows inside the mesh groove, to ensure that the air flow flows along a predetermined path and achieving efficient distribution and guidance of air. The height of 2 mm to 4 mm can provide a moderate supporting force for the feet. If the height is too small, the supporting effect will not be obvious, and may not effectively disperse the pressure on the foot. An excessively large height can cause a high pressure on part of the foot, resulting in discomfort. This height range ensures the supporting effect and comfortable wearing. The distance of 1 mm to 15 mm between the posts can effectively control the air flow rate. If the distance is too small, the flowing resistance to the air will increase, which affects the heat dissipation effect. If the distance is too large, although the air flow rate is high, the air distribution may not be uniform. This distance range can ensure that enough air can pass through the air guide mesh groove and the air can be uniformly distributed.

In this embodiment, the air hole 144 is provided in a bottom of the air guide mesh groove 1410. The air hole 144 is communicated to the accommodating space through the air guide mesh groove 1410. By the arrangement of the above structure, during use, coordinated work of the air hole 144 and the air guide mesh groove 149 can organically combine supporting, air guide, and ventilation functions of the supporting insole 140 to form a complete functional system. The supporting convex posts 149 and the air guide mesh groove 1410 provide a function of supporting and guiding the air flow, and the air hole 144 is responsible for exchanging air between the accommodating space 300 and the supporting member 110, thereby jointly improving the overall performance of the shoe.

In this embodiment, the air return slot 148 extends from a middle portion of the supporting insole 140 to a rear portion of the supporting insole 140. By the arrangement of the above structure, during use, this layout of the air return slot 148 helps to enhance convection of the air inside the shoe. In the process of the air flowing from the middle portion to the rear portion of the supporting insole 140, more air can be driven to flow to form a stronger convection effect. This convection can more effectively bring away heat and moisture that are generated by the foot, improve the heat dissipation and moisture removal effects, keep the foot dry and comfortable, and reduce discomfort and odor due to sweat accumulation and heat gathering.

In this embodiment, the shoe further includes an isolation insole 160. The isolation insole 160 is arranged between the supporting member 110 and the supporting insole 140. By the arrangement of the above structure, during use, when there are slight mismatches in size or shape between the supporting member 110 and the supporting insole 140, the isolation insole 160 can fill these gaps, to make them better fit each other and improve the overall fitness and stability. The isolation insole 160 can avoid friction caused by direct contact between the supporting member 110 and the supporting insole 140, thereby preventing frictional damage to the supporting insole 140, prolonging the service life of the supporting insole 140, and further enhancing the user experience.

In this embodiment, the isolation insole 160 is provided with an air outlet hole 161 and an air inlet hole 162. By the arrangement of the above structure, during use, the air inlet hole 162 can allow the air blown in through the blowing channel 130 to enter the accommodating space 300, and through the air outlet hole 161, original polluted air inside the shoe can be discharged, thus achieving circulation of the air inside the shoe, avoiding stuffy, humid, and odorous air inside the shoe caused by long-term wearing, and further enhancing the user experience.

In this embodiment, a hollow layer 150 is formed by the supporting insole 140 and an upper surface of the supporting member 110. The other end of the air hole 144 is configured to be communicated to the hollow layer 150. One end of the blowing channel 130 is connected to the blowing device 120, and the other end is connected to the upper surface of the supporting member 110. The blowing device 120 sucks the air from the accommodating space 300 and forms a relatively low pressure region in a region of the accommodating space 300 close to the blowing device 120, so that the air in the accommodating space 300 forms an internal circulation path, and the air circulation rate is increased. By the arrangement of the above structure, during use, the blowing device 120 sucks an air flow from the accommodating space 300 through an air inlet 121 connected to the accommodating space, and the sucked air flow enters the blowing channel 130 through an air outlet 122 via an air inlet end 131, enters the hollow layer 150 through an air outlet end 132 from the blowing channel 130, and finally flows back into the accommodating space 300, thereby forming a circulation path of the air flow, which can accelerate the circulation of the air inside and outside a shoe. This ensures that the accommodating space 300 in the shoe is dry and breathable. Furthermore, the air flow that continuously flows from the air outlet end 132 to the air inlet 121 can be formed in the accommodating space 300 in the shoe. The air flow is blown to the sole of the foot through the supporting insole 140; good ventilation, sweat discharging, and cooling effects can be achieved; the ventilation and cooling efficiency in the shoe is greatly improved; and the user experience is enhanced. The hollow layer 150 performs secondary distribution on the air blown in through the blowing channel 130, so that the air blown in through the blowing channel 130 enters the accommodating space 300 more uniformly, and the sole of the foot of the user is cooled more uniformly. The comfort level of cooling is further improved, and the user experience is enhanced. The air circulation rate in the internal air circulation path increases, thereby further improving the ventilation and cooling efficiency in the shoe and enhancing the user experience.

In this embodiment, a barrier beam 141 is arranged at the supporting insole 140. The barrier beam 141 divides the hollow layer 150 into a first hollow layer 151 and a second hollow layer 152. The first hollow layer 151 is connected to the blowing channel 130, and the second hollow layer 152 is connected to the blowing device 120. By the arrangement of the above structure, during use, the blowing device 120 sucks the air flow from the accommodating space 300 through the air inlet 121 connected to the accommodating space 300. After the sucked air flow enters the blowing channel 130 through the air outlet 122 via the air inlet end 131, and enters the hollow layer 150 through the air outlet end 132 from the blowing channel 130, the air flow is first subjected to primary diffusion in the hollow layer 150, is then subjected to secondary diffusion, and enters the accommodating space 300. In this way, the air flow finally entering the accommodating space 300 is more uniform, so that the ventilation, sweat discharging, and cooling effects are better; and the user experience is enhanced.

In this embodiment, the blowing device 120 includes the air inlet 121. The air inlet 121 is connected to the accommodating space 300. A filter screen 123 is arranged at the air inlet 121. By the arrangement of the above structure, during use, the filter screen 123 can effectively remove solid impurities such as gravels from the air flow, so that the circulation path of the air flow is smoother, and the user experience is further enhanced. It should be noted that a temperature adjustment device is arranged at the air outlet 122. The temperature adjustment device is configured to heat or cool air flow flowing out from the air outlet 122.

In this embodiment, the blowing device 120 is arranged at a middle portion of the supporting member 110. By the arrangement of the above structure, a relatively closed space is formed at a front portion of the shoe during use. The middle blowing device sucks the air flow from the accommodating space 300 through the air inlet 121 connected to the accommodating space 300. Meanwhile, the relatively low pressure region is formed near the air inlet 121, thereby increasing the air flow velocity of the air flow flowing out from the air outlet end 132 into the air inlet 121, which accelerates the circulation of the air flow. This further enhances the ventilation, sweat discharging and cooling effects of a shoe main body, improves the ventilation and cooling efficiency in the shoe, and enhances the user experience.

In this embodiment, the blowing channel 130 includes the air inlet end 131 and the air outlet end 132. The blowing device 120 includes the air outlet 122. The air inlet end 131 is connected to the air outlet 122, and the air outlet end 132 is arranged at a front portion of the supporting member 110. By the arrangement of the above structure, during use, when the air flow enters the hollow layer 150 through the air outlet end 132 from the blowing channel 130 and finally flows back to the accommodating space 300, a part of the air flow may be diverted to a region, close to the instep, on an upper portion of the accommodating space 300 through a gap in the front portion of the shoe, so that the instep of the user can also receive the good ventilation, sweat discharging, and cooling effects, which further enhances the user experience.

In this embodiment, the supporting insole 140 includes an insole surface 142 and a supporting column 143. The supporting column 143 extends downward from a lower surface of the insole surface 142 to the upper surface of the supporting member 110 to form the hollow layer 150 with the upper surface of the supporting member 110. An air hole 144 configured to communicate the accommodating space 300 to the hollow layer 150 is formed in the insole surface 142. By the arrangement of the above structure, during use, the supporting insole 140 is provided with the insole surface 142 and the supporting column 143. The supporting column 143 extends downward from the lower surface of the insole surface 142 to the upper surface of the supporting member 110, thereby ensuring that when the foot of the user is supported on the insole surface 142 of the supporting insole 140, the user feels comfortable. The hollow layer 150 is formed by the supporting insole 140 and the upper surface of the supporting member 110, which greatly reduces the wind impedance of the supporting insole 140 and can ensure an unblocked air flow channel. Furthermore, most of the air flow enters the hollow layer 150 from the blowing channel 130 through the air outlet end 132. After being distributed through the air hole 144 in the insole surface 142 again, the air flow can be relatively uniformly blown to the sole of the foot of the user, thereby achieving better ventilation, sweat discharging, and cooling effects, improving the ventilation and cooling efficiency in the shoe, and enhancing the user experience.

In this embodiment, the supporting insole 140 includes an insole surface 142 and a supporting column 143. The supporting column 143 extends downward from a lower surface of the insole surface 142 to the upper surface of the supporting member 110 to form the hollow layer 150 with the upper surface of the supporting member 110. A ventilation slot 145 configured to communicate the accommodating space 300 to the hollow layer 150 is formed in a side surface of the insole surface 142. By the arrangement of the above structure, during use, the supporting insole 140 is provided with the insole surface 142 and the supporting column 143. The supporting column 143 extends downward from the lower surface of the insole surface 142 to the upper surface of the supporting member 110, thereby ensuring that when the foot of the user is supported on the insole surface 142 of the supporting insole 140, the user feels comfortable. The hollow layer 150 is formed by the supporting insole 140 and the upper surface of the supporting member 110, which greatly reduces the wind impedance of the supporting insole 140 and can ensure an unblocked air flow channel. Furthermore, a little of the air flow enters the hollow layer 150 from the blowing channel 130 through the air outlet end 132.

After being distributed through the ventilation slot 145 in the side surface of the insole surface 142 again, the air flow can be blown to the instep of the user through a gap on the side surface, thereby achieving better ventilation, sweat discharging, and cooling effects, improving the ventilation and cooling efficiency in the shoe, and enhancing the user experience.

In this embodiment, the supporting insole 140 is provided with a ventilation unit 146. The ventilation unit 146 extends from a middle portion of a front end of the supporting insole 140 to a side portion of the front end. By the arrangement of the above structure, during use, when the air flow enters the hollow layer 150 through the air outlet end 132 from the blowing channel 130 and finally flows back to the accommodating space 300, a part of the air flow may extend to the ventilation unit 146 at the side portion of the front end through the middle portion of the front end of the shoe and enter a gap between the front portion of the shoe and the side portion of the shoe, so that the air flow is diverted to regions, close to the instep, on the upper part and side portion of the accommodating space 300, so that the upper part and side portion of the instep of a user can also receive the good ventilation, sweat discharging, and cooling effects, which further enhances the user experience.

In this embodiment, the blowing device 130 includes a power supply 124, a fan 125, and a circuit board 126. By the arrangement of the above structure, during use, the power supply 124, the fan 125, and the circuit board 126 are mounted in the supporting member. The power supply 124 is electrically connected to the fan 125 through the circuit board 126 and provides electrical energy to the fan 125. The fan converts the electrical energy into mechanical energy for fan blade rotation, and adjusts the distribution of the air flow in the shoe, so that good ventilation, sweat discharging, and cooling effects are achieved, and the user experience is further enhanced. The power supply 124 can use a lithium battery with a high energy density, to reduce the charging frequency of a user. Meanwhile, the weight of the battery is reduced, and the user experience is further enhanced.

In this embodiment, the power supply 124 and the circuit board 126 are arranged at a rear portion of the supporting member 110. By the arrangement of the above structure, during use, the power supply 124 and the circuit board 126 are arranged at the rear portion of the supporting member 110 with a sufficient accommodating space, and a buffer thermal insulation pad is arranged above the power supply and the circuit board and corresponds to a heel region of a user. On the one hand, it can provide a better supporting experience for the heel. On the other hand, it can isolate heat emitted by the power supply 124 and the circuit board 126 during use. Therefore, the power supply 124 and the circuit board 126 are arranged at the rear portion of the supporting member 110, which can further enhance the user experience.

In this embodiment, the power supply 124 is removable. By the arrangement of the above structure, during use, the depleted power supply 124 can be replaced at any time by a backup power supply, and the depleted power supply 124 is conveniently connected to a power supply, without taking off the shoe for charging, thereby further enhancing the user experience.

In this embodiment, the supporting member 110 is provided with a temperature sensing device. The temperature sensing device is configured to detect a temperature in the accommodating space 300. The temperature sensing device is controlled by a preset program in a mobile terminal. The preset program automatically adjusts power of the fan 125 according to a data change fed back by the temperature sensing device. The preset program controls the temperature of the air flow in the accommodating space 300 in the shoe through the following steps:

Step I: A user enters a mini program that controls the preset program and sets a target temperature X.

Step II: The temperature sensing device detects the temperature of the air flow in the accommodating space in the shoe.

Step III: When the temperature of the air flow in the accommodating space 300 in the shoe is less than X+1 degrees, the fan 125 is automatically turned on at a first speed to adjust the temperature of the air flow in the accommodating space 300 in the shoe. When the temperature of the air flow in the accommodating space 300 in the shoe is greater than or equal to X+1 degrees and less than X+3 degrees, the fan 125 is automatically turned on at a fifth speed to adjust the temperature of the air flow in the accommodating space 300 in the shoe. When the temperature of the air flow in the accommodating space 300 in the shoe is greater than or equal to X+3 degrees, the fan is automatically turned on at a tenth speed to adjust the temperature of the air flow in the accommodating space 300 in the shoe. When the temperature of the air flow in the accommodating space 300 in the shoe is less than X-2 degrees, the fan is turned off.

Step IV: The temperature sensing device continuously detects the temperature of the air flow in the accommodating space in the shoe, and feeds back detected temperature data to the preset program. The preset program cyclically executes step III.

In this embodiment, the supporting convex posts 149 are substantially uniformly distributed on the insole surface 142. By the arrangement of the above structure, during use, various parts of the foot can be uniformly stressed, thus avoiding excessive local pressure, reducing fatigue and pain, and providing a better support for long-term walking or standing.

In this embodiment, a cross section of each supporting convex post 149 is circular or polygonal. By the arrangement of the above structure, during use, the circular cross section has a smooth surface, which provides a soft and rounded support when it is in contact with the foot, thus reducing friction and stimulation on the foot, and improving the comfort level. Corners and edges of the polygonal cross section can increase a friction force with the foot, thus making a relative displacement between the insole and the foot small and better fixing the position of the foot.

As described above, one or more embodiments are provided in conjunction with the detailed description, The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

The invention claimed is:

1. A shoe, comprising a shoe sole and a shoe main body, wherein the shoe sole is configured to be connected to the shoe main body and forms an accommodating space with the shoe main body; the shoe sole comprises:

a supporting member, wherein the supporting member is provided with a blowing device and a blowing channel; the blowing device is communicated to the blowing channel and conveys air to the accommodating space through the blowing channel; and a supporting insole, wherein the supporting insole comprises an insole surface; an air hole is provided in the insole surface; one end of the air hole is configured to be communicated to the accommodating space; the supporting insole is arranged on the supporting member; the blowing device sucks the air from the accommodating space and forms a relatively low pressure region in a region of the accommodating space close to the blowing device, so that an air passage rate is increased while the air inside the accommodating space forms an internal circulation path;

wherein the supporting insole further comprises an abutted surface, the insole surface and the abutted surface are respectively arranged on two opposite sides of the supporting insole; and the other end of the air hole is communicated to the abutted surface;

the blowing device comprises an air inlet and an air outlet, and the air inlet is in communication with the accommodating space through the air hole, the air outlet faces the blowing channel, the supporting insole is provided with a ventilation unit, the ventilation unit is in communication with the blowing channel and the accommodating space, thereby the internal circulation path is formed by the accommodating space, via the blowing device, the blowing channel, the ventilation unit to return to the accommodating space.

2. The shoe according to claim 1, wherein supporting convex posts are arranged on the insole surface; the supporting convex posts are fixedly connected to the insole surface, and the supporting convex posts and the insole surface together form an air guide mesh groove; the supporting convex posts are configured to support a foot of a user; the air guide mesh groove is configured to form an air flow path to perform secondary distribution on the air blown in through the blowing channel, so that the air blown in through the blowing channel enters the accommodating space more uniformly through the air guide mesh groove.

3. The shoe according to claim 1, wherein a temperature adjustment device is arranged at the air outlet; and the temperature adjustment device is configured to heat or cool air flow flowing out from the air outlet.

4. The shoe according to claim 2, wherein a height of each supporting convex post is at least 1 mm; a distance between the supporting convex posts is 1 mm to 15 mm; a depth of the air guide mesh groove is limited by the heights of the supporting convex posts; and a groove width of the air guide mesh groove is limited by the distance between the supporting convex posts.

5. The shoe according to claim 1, further comprising an isolation insole, wherein the isolation insole is arranged between the supporting member and the supporting insole; and the isolation insole is provided with an air outlet hole and an air inlet hole.

6. The shoe according to claim 5, wherein a hollow layer is formed by the supporting insole and an upper surface of the supporting member; the other end of the air hole is configured to be communicated to the hollow layer; and one end of the blowing channel is connected to the blowing device, and the other end is connected to the upper surface of the supporting member.

7. The shoe according to claim 6, wherein the supporting insole comprises an insole surface and a supporting column; the supporting column extends downward from a lower surface of the insole surface to the upper surface of the supporting member to form the hollow layer with the upper surface of the supporting member; the air hole configured to communicate the accommodating space to the hollow layer is provided in the insole surface; the hollow layer performs secondary distribution on the air blown in through the blowing channel, so that the air blown in through the blowing channel enters the accommodating space more uniformly through the air hole.

8. The shoe according to claim 6, wherein the supporting insole comprises a supporting column; the supporting column extends downward from a lower surface of the insole surface to the upper surface of the supporting member; and the supporting column is configured to support the insole surface.

9. The shoe according to claim 7, wherein the supporting column extends downward from a lower surface of the insole surface to the upper surface of the supporting member to form the hollow layer with the upper surface of the supporting member; and a ventilation slot configured to communicate the accommodating space to the hollow layer is formed in a side surface of the insole surface.

10. The shoe according to claim 5, wherein the ventilation unit extends from a middle portion of a front end of the supporting insole to a side portion of the front end.

11. The shoe according to claim 5, wherein the blowing device comprises a power supply, a fan, and a circuit board.

12. The shoe according to claim 11, wherein the power supply is removable.

13. The shoe according to claim 5, wherein the supporting member is provided with a temperature sensing device; the temperature sensing device is configured to detect a temperature in the accommodating space; the temperature sensing device is controlled by a preset program in a mobile terminal; and the preset program automatically adjusts power of the fan according to a data change fed back by the temperature sensing device.

14. The shoe according to claim 5, wherein the blowing device is arranged at a middle portion of the supporting member.

15. The shoe according to claim 2, wherein the supporting convex posts are substantially uniformly distributed on the insole surface; and a cross section of each supporting convex post is circular or polygonal.

16. The shoe according to claim 2, wherein the air hole is provided in a bottom of the air guide mesh groove; and the air hole is communicated to the accommodating space through the air guide mesh groove.

17. The shoe according to claim 1, wherein the abutted surface is provided with an air return slot; and the other end of the air hole is configured to be communicated to the air return slot.

18. The shoe according to claim 17, wherein the air return slot extends from a middle portion of the supporting insole to a rear portion of the supporting insole.

19. A shoe, comprising a shoe sole and a shoe main body, wherein the shoe sole is configured to be connected to the shoe main body and forms an accommodating space with the shoe main body; the shoe sole comprises:

a supporting insole comprising an insole surface and an opposite abutted surface; wherein a plurality of air holes are provided in the insole surface, one end of each of the air holes is configured to be communicated to the accommodating space, and the other end of each of the air holes is communicated to the abutted surface;

a supporting member supporting the supporting insole, wherein the supporting member is provided with a blowing device and a blowing channel; an air inlet of the blowing device is in communication with the accommodating space through the air hole, and an air outlet of the blowing device is communicated to the blowing channel and conveys air to the accommodating space through the blowing channel, thereby the blowing device sucks the air from the accommodating space and forms a relatively low pressure region in a region of the accommodating space close to the blowing device, so that an air passage rate is increased while the air inside the accommodating space forms an internal circulation path;

wherein supporting convex posts are arranged on the insole surface; the supporting convex posts are fixedly connected to the insole surface, and the supporting convex posts and the insole surface together form an air guide mesh groove at a space between adjacent supporting convex posts on the insole surface; the supporting convex posts are configured to support a foot of a user; the air guide mesh groove is configured to form an air flow path to perform secondary distribution on the air blown in through the blowing channel, so that the air blown in through the blowing channel enters the accommodating space more uniformly through the air guide mesh groove.

* * * * *